US010941515B2

(12) United States Patent
Chai et al.

(10) Patent No.: US 10,941,515 B2
(45) Date of Patent: Mar. 9, 2021

(54) CHEST IRONER

(71) Applicant: SHANGHAI WEISHI MACHINERY CO., LTD., Shanghai (CN)

(72) Inventors: Guoxuan Chai, Shanghai (CN); Jinhua Peng, Shanghai (CN); Jie Zhou, Shanghai (CN); Feng Liu, Shanghai (CN)

(73) Assignee: SHANGHAI WEISHI MACHINERY CO., LTD., Shanghai (CN)

( * ) Notice: Subject to any disclaimer, the term of this patent is extended or adjusted under 35 U.S.C. 154(b) by 90 days.

(21) Appl. No.: 16/235,963

(22) Filed: Dec. 28, 2018

(65) Prior Publication Data

US 2019/0161908 A1 May 30, 2019

Related U.S. Application Data

(63) Continuation of application No. PCT/CN2017/080909, filed on Apr. 18, 2017.

(30) Foreign Application Priority Data

Dec. 19, 2016 (CN) ..... 2016 1 1179184
Feb. 14, 2017 (CN) ..... 2017 1 0078033

(51) Int. Cl.
*D06F 65/08* (2006.01)
*D06F 65/10* (2006.01)
(Continued)

(52) U.S. Cl.
CPC ..... *D06F 65/08* (2013.01); *D06F 65/10* (2013.01); *D06F 67/02* (2013.01); *D06F 67/08* (2013.01)

(58) Field of Classification Search
CPC .... D06F 65/00–10; D06F 67/02; D06F 67/06; D06F 67/08
See application file for complete search history.

(56) References Cited

U.S. PATENT DOCUMENTS 3,484,966 A * 12/1969 Dahlquist ..... D06F 65/10 38/55
4,414,765 A * 11/1983 Kreisberg ..... D06F 67/00 38/54
5,022,169 A 6/1991 Jensen

FOREIGN PATENT DOCUMENTS

CN 201258422 6/2009
CN 201265112 Y * 7/2009
(Continued)

OTHER PUBLICATIONS

Written Opinion dated Sep. 25, 2017, corresponding to International Patent Application No. PCT/CN2017/080909, with English translation.

(Continued)

*Primary Examiner* — Ismael Izaguirre
(74) *Attorney, Agent, or Firm* — Leason Ellis LLP

(57) ABSTRACT

The invention relates to a chest ironer, and belongs to the technical field of ironing machines. The chest ironer comprises an ironing chest set including arc-shaped ironing chests with upward arc-shaped openings. The ironing chest set includes at least one solid chest and at least one flexible chest, and bridge chests with downward arc-shaped openings are disposed between the ironing chests. The first ironing chest of the ironing chest set is a solid chest, the second ironing chest of the ironing chest set is a flexible chest, and the bridge chest between the first ironing chest and the second ironing chest is a first bridge chest. A horizontal steam chamber partition plate is fixedly arranged at the longitudinal middle position of an outer arc-shaped face plate of an inner chest plate of the solid chest in the horizontal direction, and at least one longitudinal steam chamber partition plate is arranged on the outer arc-shaped face plate of the inner chest plate in the longitudinal direction, so that the ironing chest is partitioned into at least four (Continued)

steam chambers. Each steam chamber is provided with an independent branched steam pipe communicated with a main steam pipe used for centralized supply of steam. The chest ironer is further provided with an adjustable pressurization system. The invention greatly improves the ironing effect under a limited steam pressure.

22 Claims, 8 Drawing Sheets

(51) Int. Cl.
*D06F 67/02* (2006.01)
*D06F 67/08* (2006.01)

(56) References Cited

FOREIGN PATENT DOCUMENTS

| | | | | |
|---|---|---|---|---|
| CN | 201358389 | | | 12/2009 |
| CN | 101760948 | | | 6/2010 |
| CN | 106436244 | | | 2/2017 |
| CN | 206376135 | | | 8/2017 |
| DE | 3401801 | A | * | 8/1985 |
| DE | 3733369 | A | * | 7/1988 |
| DE | 19702644 | A1 | * | 7/1998 |
| DE | 102009016709 | | | 10/2010 |
| EP | 2628847 | A1 | * | 8/2013 |
| GB | 1639333 | A | * | 12/1934 |

OTHER PUBLICATIONS

International Search Report dated Sep. 25, 2017 corresponding to International Patent Application No. PCT/CN2017/080909; 3 pages.

* cited by examiner

CHEST IRONER

BACKGROUND OF THE INVENTION

Technical Field

The invention relates to a chest ironer, and belongs to the technical field of ironing machines.

Description of Related Art

Ironing machines are used by laundries for the after-treatment process. In this process, washed and pre-dried linen, such as bed sheets and quilt covers, is fed into the ironing machine to evaporate moisture left in the linen, and after being heated and pressurized in the ironing machine, the linen becomes dry and flat. The ironing machines include chest ironers and roller ironing machines according to the structural configuration. It can be approximately interpreted by name that the chest ironers are based on chest heating, while the roller ironing machines are based on roller heating.

As the core component of the chest ironers, two types of ironing chests are usually adopted nowadays: solid chest made from thick steel plates through welding and machining and flexible chest made from thin steel plates through welding and polishing. The solid chest is designed in terms of the standard of pressure vessels in such a manner: a thick low-carbon steel plate with a thickness of about 20 mm is coiled into a semicircle, the outer arc surface of the thick low-carbon steel plate is covered with a plurality of thin steel plates, a cavity formed after the thick low-carbon steel plate and the thin steel plates are welded and sealed together is used as a steam chamber, the inner arc surface of the semicircular steel plate is machined and polished, and then a heat-conducting medium (generally steam or thermal oil) is injected into the cavity to heat the chest body. In use, a big roller in which springs and felt are wrapped is placed in the solid chest, linen is drawn into the ironing chest along with the roller and is heated, dehumidified, pressurized and rubbed in the ironing chest, and finally, dry and flat linen is obtained.

The flexible chest is designed in such as manner: two stainless steel plates with different thicknesses are welded together and are then coiled to form a semicircular chest, water is injected into the semicircular chest for pressurization, the thin plate deforms and bulges to form a steam chamber, and the thick plate is polished to serve as an ironing chest of the ironing machine like the solid chest.

Due to the structural difference between the solid chest and the flexible chest, the weight of the solid chest is several times that of the flexible chest, while the heat conductivity of the low-carbon steel plate is better than that of stainless steel, so that compared with the flexible chest, heat in the solid chest is lost at a much lower speed, which means that the heat storage performance of the solid chest is better. The flexible chest made from stainless steel plates can be pre-heated rapidly, is resistant to corrosion and has a smooth surface, the flexible chest body applies a uniform pressure to linen under the pressure of a roller, and thus, the flexible chest is advantageous over the solid chest in ironing quality. In addition, compared with the solid chest, the flexible chest is simple in machining process and high in cost performance, but has a high pressure requirement for steam sources.

Existing chest ironers have the following defects:

1. Nowadays, steam from power plants, coil-fired boilers, oil-fired boilers and air-fired boilers is usually used by domestic laundry factories to serve as the heat source of ironing machines, but stable air supply at a pressure over 0.6 MPa to the ironing machines cannot be ensured by most factories due to air supplies or the installed capacity; after wet linen enters the first chest, a large quantity of moisture in the wet linen is taken away, the temperature of the chest falls quickly, and at this moment, if heat cannot be supplemented in time, the linen will be wrinkled and coiled once the temperature of the chest is lower than a certain value.

2. When steam is used as the heat-conducting medium to heat the solid chest, the steam enters the cavity in the chest from the two sides of the upper end of an opening of the arc-shaped chest and flows through communicated steam chambers formed by an arc-shaped cover plate to transmit heat to the inner chest plate, and the rest of steam and condensate flow out from the bottom of the ironing chest. In order to heat such a big ironing chest, steam needs to be continuously supplied to exchange heat with the chest body when circulating in the steam chambers, and condensate is formed continuously in this process; when reaching the bottom of the chest after passing through the long zigzag steam chambers, the steam has been turned into unsaturated steam containing too much moisture, the enthalpy value of the steam is greatly decreased, and consequentially, the temperature of the bottom of the chest is lower than that of the two ends of the chest; however, when the ironing machine operates, the whole surface, to be pressurized and heated under the pressure of the roller, of the linen is located at the bottom of the chest, and consequentially, the actual ironing effect may fail to meet the ironing requirement due to non-uniform heat distribution of the semicircular chest.

3. Condensate in an existing ironing chest is discharged via a condensate drain pipe at the bottom of the ironing chest, the opening degree of a condensate control valve is pre-set, after the ironing machine is stopped, part of the condensate is left in the ironing chest and cannot be discharged via the condensate drain pipe due to a low pressure, and consequentially, when the ironing machine is started again, the heating speed of the ironing chest will be decreased by the condensate left in the ironing chest, which has a negative influence on the temperature uniformity and ironing effect of the ironing chest.

4. An exhaust port is formed in one side of the roller of the ironing machine and is connected with a fan to discharge the steam generated by evaporation of the linen; and a transmission flange is arranged on the other side of the roller of the ironing machine and is driven by power transmitted to the roller from the motor through a speed reducer to rotate, and the roller is coaxially connected with the speed reducer. The speed reducer and the fan have different weights, the pressures applied to the linen by the two sides of the roller are inconsistent under the influence of the weight difference, and consequentially, the linen may be inclined or wrinkled after being ironed.

BRIEF SUMMARY OF THE INVENTION

The objective of the invention is to provide a chest ironer provided with a solid chest and a flexible chest which are connected by an improved bridge chest between the solid chest and the flexible chest. The invention further provides a multi-cavity rigid ironing chest which is so design that longitudinal and horizontal partition plate are used to partition a steam chamber in the ironing chest into at least four independent cavities and that each cavity is provided with an independent steam inlet port, an independent exhaust port and an independent drain port, thus, improving the heating efficiency. The invention further provides an adjustable pressurization system and method of the chest ironer to provide different ironing pressures for ironed products with different sizes and thicknesses and made from different materials such as bed sheets and quilt covers and to balance the gravities of the two ends, respectively connected with a speed reducer and a fan, of the chest ironer, thus, improving the ironing effect on the ironed products (specially thick quilt covers or other thick products).

The following technical solution is adopted by the invention.

A chest ironer comprises an ironing chest set including arc-shaped ironing chests with upward arc-shaped openings. The ironing chest set comprises at least one solid chest and at least one flexible chest. Bridge chests with downward arc-shaped openings are disposed between the ironing chests. The first ironing chest of the ironing chest set is a solid chest, the second ironing chest of the ironing chest set is a flexible chest, and the bridge chest between the first ironing chest and the second ironing chest is a first bridge chest. Bridge chest installation holes (1) to be connected with horizontal edges of the bridge chest are formed in the horizontal edges of two ends of the solid chest. The bridge chest (22) is fixed to frames of the solid chest and the flexible chest through installation frames (9) on two sides of the bridge chest (22).

Furthermore, the installation frames on the two sides of the bridge chest are connected with one ends of adjustment screw rods (10), and the other ends of the adjustment screw rods (10) are connected with the lower edge of the discharging end of the bridge chest. A plurality of sets of first and second connecting rods (14 and 15) are arranged in the bridge chest. Each first connecting rod (14) has an end fixed to the end of the bridge chest and an end forming a cross structure together with the corresponding second connecting rod (15) through a bolt and a tie rod (13). The first and the second connecting rods (14 and 15) can be driven to adjust the opening degree of the bridge chest by tightening or loosening the screw rods at the outer ends of the tie rods (13).

Furthermore, the first and second connecting rods (14 and 15) are uniformly distributed at two ends of the bridge chest in the length direction, and the lower edge of the discharging end of the bridge chest and the upper edge of the feeding end of the flexible chest can be aligned with a certain gap reserved therebetween through the first and second connecting rods (14 and 15) and the adjustment screw rods (10) to make sure that linen smoothly enters the next chest from the current chest.

Furthermore, each of plate sealing parts on two sides of the solid chest has four planes through which the solid chest (19) is fixed to installation sites (18) of the frame bearing the weights of the solid chest (19) and a roller (20) as well as a pressure from the roller (20). A front supporting plate (23) has an end fixed to the frame and an end connected to a front supporting plate installation site (8). A rear supporting plate (26) is able to move towards the center of a roller (25) under the pressure of the roller (25) after a lower end of the rear supporting plate (26) is fixed to the frame and an upper end of the rear supporting plate (26) is inserted into a rear supporting plate installation site (4), so that the pressures borne by the linen at the bottom and the two ends of the chest are close, and a better ironing effect is achieved.

Furthermore, the ironing set includes three ironing chests, wherein the first ironing chest is a solid chest, the second ironing chest is a bridge chest, and the third chest is a flexible chest.

Furthermore, the solid chest comprises an inner chest plate and an outer arc-shaped face plate. A horizontal steam chamber partition plate (57) is fixedly arranged at the longitudinal middle position of the outer arc-shaped face plate in the horizontal direction, and at least one longitudinal steam chamber partition plate (51) is arranged on the outer arc-shaped face plate of the inner chest plate in the longitudinal direction, so that the ironing chest is partitioned into at least four steam chambers. The steam chambers on two sides of the horizontal steam chamber partition plate (57) are symmetrically distributed, and the adjacent steam chambers on the same side of the horizontal steam chamber partition plate (57) are completely identical. Each steam chamber is provided with a branched steam pipe communicated with a main steam pipe used for centralized supply of steam.

Furthermore, each steam chamber is provided with a condensate drain pipe and a bypass drain pipe, wherein the condensate drain pipe is connected with an external steam trap, the bypass drain pipe is used for rapidly discharging initial condensate left in the ironing chest only when steam is initially supplied into the ironing chest and is closed after a chest body is heated, and condensate is then discharged via the steam trap of the condensate drain pipe.

Furthermore, exhaust ports at the top ends of steam chamber plates in the steam chambers are connected with automatic steam exhaust valves so that air left in the ironing chest can be exhausted and the steam chamber of the ironing chest can be rapidly filled with steam.

Furthermore, the condensate drain pipes are connected to a main condensate recovery pipeline through the corresponding steam traps, and the bypass drain pipes are combined through a drain valve to be connected to the main condensate recovery pipeline.

Furthermore, one longitudinal steam chamber partition plate (51) is arranged on the outer arc-shaped face plate of the inner chest plate in the longitudinal direction, so that the ironing chest is partitioned into four steam chambers.

Furthermore, temperature sensors are installed on the inner chest plate. The bypass drain pipes are provided with steam valves. When the temperature of the ironing chest falls abnormally in the start-up pre-heating stage or the operating stage, a control system sends out a signal to open the steam valves, so that condensate accumulated in the ironing chest is rapidly discharged.

Furthermore, the steam chamber partition plate additionally arranged at the middle position of the solid chest downwards stretches out of the outer arc-shaped face plate to serve as a reinforcing rib of the inner chest plate and the outer arc-shaped face plate.

Furthermore, the roller of the chest ironer has two ends which are respectively a light end and a heavy end. The chest ironer is provided with an adjustable pressurization system. The adjustable pressurization system comprises a pressure air supply, an electromagnetic valve set and at least one pressure control unit. The pressure supply is connected with the electromagnetic valve set. The electromagnetic valve set is connected with the at least one pressure control unit and includes an electromagnetic valve Y1, an electromagnetic valve Y2 and an electromagnetic valve Y3. The pressure air supply is communicated with the electromagnetic valve Y1, the electromagnetic valve Y2 and the electromagnetic valve Y3. The pressure control unit comprises a cylinder C1 located at the light end of the roller and a cylinder C2 located at the heavy end of the roller. The electromagnetic valve Y1 is communicated with an electro-pneumatic regulator R1 and an electro-pneumatic regulator R2. The electro-pneumatic regulator R1 is communicated with a piston rod side of the cylinder, and the electro-pneumatic regulator R2 is communicated with a piston rod side of the cylinder C2. The electromagnetic valve Y2 is communicated with rodless cavities of the cylinders C1 and C2. The electromagnetic valve Y3 is communicated with the rodless cavity end of the cylinder C2 through an electro-pneumatic regulator R3.

Furthermore, the pressure control unit further comprises a quick exhaust valve Q1, a quick exhaust valve Q2, a quick exhaust valve Q3 and a quick exhaust valve Q4. The electro-pneumatic regulator R1 is communicated with the piston rod side of the cylinder through the quick exhaust valve Q1. The electro-pneumatic regulator R2 is communicated with the piston rod end of the cylinder C2 through the quick exhaust valve Q2. The electro-pneumatic regulator R3 is communicated with the rodless cavity side of the cylinder C2 through the quick exhaust valve Q3. An air outlet of the quick exhaust valve Q3 is connected to the rodless cavity of the cylinder C2, and an exhaust port of the quick exhaust valve Q3 is connected to the rodless cavity of the cylinder C1.

Furthermore, the electromagnetic valves of the electromagnetic valve set are connected with other pressure control units through bypass air paths a, b and c respectively located on air paths of the electromagnetic valves Y1, Y2 and Y3. Each pressure control unit corresponds to one roller of the ironing machine.

Furthermore, the cylinders C1 and C2 are connected with flanges on two sides of the roller through two bearing seats respectively. Piston rods of the cylinders stretch or retreat to lift or lower the roller without affecting rotation of the roller. The cylinder C1 corresponds to the exhaust port flange, and the cylinder C2 corresponds to the transmission shaft flange. The electro-pneumatic regulators R1 and R2 respectively control the pressures of two air paths. After the electromagnetic valve Y1 is powered on, the roller is lowered under the combined action of the self gravity and the air pressure. When the roller is lowered to the bottom position, air is supplied to the electromagnetic valve Y1 again, so that a downward pressure from the cylinders is applied to the roller.

A pressurization method of the adjustable pressurization system of the chest ironer comprises the following steps:

S1, powering on the electromagnetic valve Y1, so that air enters rod cavities of the cylinders C1 and C2, air in the rodless cavities of the cylinders C1 and C2 is exhausted via the quick exhaust valve Q3 connected to an air pipe under the combined action of a roller gravity and an air pressure, and then the piston rods of the cylinders retreat to lower the roller in position;

S2, as for a light and thin to-be-ironed article, directly ironing the to-be-ironed article by means of the roller gravity; or, powering on the electromagnetic valve Y3 to control air intake on the rodless cavity side of the cylinder C2, so that an addition path of air provides an upward force for the piston rod of the cylinder C2 to regulate the pressure of the pressure reducing valve R3 and to counteract a weight difference between the heavy end and the light end; as for a thick and heavy to-be-ironed article, continuing to power on the electromagnetic valve Y1 to apply a downward pressure to the roller, and carrying out pressure distribution in real time through the electromagnetic proportional valves R1 and R2 to make the pressure of the cylinder C2 at the heavy end lower than the pressure of the cylinder C1 at the light end, wherein a pressure difference between the heavy end and the light end is set as a gravity difference between the two ends of the roller; and S3, after the article is ironed, powering on the electromagnetic valve Y2 to control air intake on the rodless cavity sides of the cylinders C1 and C2, so that the roller is upwards lifted in position.

Furthermore, in step 2, the quick exhaust valve Q3 of the path of balance air controlled by the electromagnetic valve Y3 is provided with an air inlet connected with compressed air from the pressure reducing valve R3, an air outlet connected to the rodless cavity of the cylinder C2 and an exhaust port connected to the rodless cavity of the cylinder C1; in terms of the characteristics of the quick exhaust valve, air flow entering the quick exhaust valve via the air inlet can be exhausted only via the air outlet, and air flow entering the quick exhaust valve via the air outlet or the exhaust port can be exhausted only via the exhaust port or the air outlet and cannot flow towards the air inlet; after entering the quick exhaust valve Q3 via the air inlet, the balance air is exhausted only via the air outlet, so that the cylinder C2 is lifted while the cylinder C1 will not move; when the cylinders C1 and C2 need to be lifted or lowered at the same time, the rodless cavities of the two cylinders are communicated, so that air enters or comes out of the two cylinders at the same time.

Furthermore, in step S3, after the electromagnetic valve Y2 is powered on, air enters the rodless cavities of the cylinders C1 and C2, and air in the rodless cavities of the cylinders is exhausted via the quick exhaust valves Q1 and Q2 connected to the air pipe, so that the piston rods of the cylinders stretch to push the bearing seats to rapidly lift the roller.

Furthermore, manual stop valves L1 and L2 respectively control air paths of the rod cavities of the cylinders C1 and C2, a manual stop valve L3 controls air paths of the rodless cavities of the cylinders C1 and C2, and when the manual stop valves are closed, air is prevented from entering or coming out of the cylinders, so that the cylinders are locked.

Furthermore, air path ports a, b and c are used to be connected to a multi-roller unit, and in a chest ironer system with two or three chests, rising, falling and pressurizing of all roller cylinders are controlled in a unified manner by the three electromagnetic valves Y1, Y2 and Y3.

Furthermore, pressures of the electro-pneumatic regulators R1 and R2 are regulated according to different types of linen, state values are collated to form a database to be stored in a PLC, and programs used for outputting corresponding pressures without halts are compiled, so that users can process various types of linen according to corresponding program numbers; two online humidometers are separately installed between a feeder and an inlet of the ironing machine as well as between the ironing machine and an outlet of a folding machine and are used to measure humidity values of the linen before and after ironing in real time, the humidity values are fed back to the PLC for establishing the database, and then the ironing machine is able to automatically adjust the pressurization value and the operating speed.

The invention has the following beneficial effects:

1) The good heat storage performance of the solid chest and the good ironing effect of the flexible chest of the ironing machine are combined; linen containing a large quantity of moisture enters the solid chest in which most moisture in the linen is taken away, and meanwhile, halts caused by sudden temperature falling, resulting from insufficient steam supply, of the chest body are avoided; afterwards, the damp-dry linen enters the flexible chest, thanks to the rapid heat-exchange capacity, smooth contact surface and good wrapping performance of the flexible chest of the thin plate structure, a good ironing quality is realized, and potential problems caused by full-solid chests or full-flexible chests are avoided for domestic laundries.

2) The drawback that flexible ironing chests cannot be used under insufficient pressures of steam sources in Chain is overcome, and thus, the technical bottleneck in ironing effect is broken.

3) The design of the bridge chest is optimized to achieve good combination of the solid chest and the flexible chest.

4) The structure of the bridge chest is ingeniously adjusted and designed.

5) The solid chest and the flexible chest are combined, so that energy is saved, the ironing quality is ensured, and the long-existing technical problems of insufficient pressures of steam sources and poor ironing effect in this field are solved.

6) The heating efficiency is improved through the multi-cavity rigid ironing chest which is designed in such a manner that longitudinal and horizontal partition plates are used to partition the steam chamber in the ironing chest into at least four independent cavities each provided with an independent steam inlet port, an independent exhaust port and an independent drain port.

7) The generation of unsaturated steam at the bottom of the ironing chest is dramatically reduced, which in turn decreases the quantity of water generated in the ironing chest and prevents the enthalpy value of steam from being decreased to keep the uniform steam temperature in the cavities, and thus, the ironing effect is improved.

8) Each steam chamber is provided with a bypass drain pipe which is used for rapidly discharging initial condensate left in the ironing chest only when steam is initially supplied into the ironing chest, so that the temperature rise speed of the ironing chest is increased, the temperature rise time of the ironing chest is shortened, and accordingly, the efficiency, temperature uniformity and ironing effect of the ironing chest are greatly improved.

9) The temperature sensors and the steam valves are used to automatically control the bypass drain pipes to open or close to make sure that condensate in the chest is discharged in time via the bypass drain pipes, so that the intelligence level of the operation of the ironing chest is improved.

10) Due to the fact that common solid chests belong to the category of Class-I pressure vessels (corresponding to the national standard GB150-2011), corresponding manufacturing plants have to possess the pressure vessel manufacturing license and need to strictly follow relevant technical standards in the manufacturing and checkout process; however, in the invention, the heating steam chamber of the solid chest is divided into a plurality of independent cavities with a volume smaller than 30 L, so that the solid chest meeting the pressure vessel standard no longer belongs to the category of pressure vessels, and various limitations in the manufacturing and using process are avoided.

11) Each heating steam chamber is provided with an independent steam inlet port, an independent exhaust port and an independent drain port so that steam can circulate more smoothly and cold heating water can be directly discharged, thus, improving the heating efficiency and increasing the operating speed of the ironing machine.

12) Service restrictions of the solid chest are reduced so that the solid chest can still operate normally under lower and less instable pressure conditions.

13) The steam chamber partition plate additionally arranged at the middle position of the solid chest is also used as a reinforcing rib of the arc-shaped chest plate in contact with linen, so that heat distortion caused when steam is guided into the chest is reduced, and a better ironing effect is ensured.

14) By adoption of the multi-cavity solid chest in conformity with the redundant design principle, when a certain cavity is blocked or leaks or a certain valve is broken, the ironing chest will not stop operating immediately, which ensures that the ironing machine, serving as the key equipment in the after-treatment process in modern laundries, can still operate under a fault, and this is of great importance for timely delivery of the current batch of linen to customers.

15) The adjustable pressurization system is provided to widen the service conditions of the ironing machine by adjusting the output pressures of the electro-pneumatic regulators, so that the optimal roller pressure is provided for linen made from different materials and having different thicknesses and moisture contents, thus, improving the ironing effect and the ironing speed.

16) Under a service requirement for common ironing speed and quality, the cylinders are not pressurized or are slightly pressurized to prolong the service life of felt.

17) An additional path of balance air is adopted to counteract the weight difference between the two sides of the roller, so that the ironing effect is improved, and the felt on the roller is evenly worn, which may otherwise result in the situation that the whole felt has to be replaced because one side of the felt is worn first.

18) Through the modular design, a single-roller or multi-roller ironing machine can be conveniently assembled for use.

19) The roller lifting cylinders of all units are manually locked to ensure the safety when the ironing machine is stopped and maintained; in addition, when multiple rollers are combined for use, a specific roller can be operated, and this is beneficial to debugging.

20) The ironing machine can automatically select the optimal matching program according to feedback signals from the stability sensors and the humidometer at the outlet of the ironing machine, so that the intelligence level of the operation of the ironing chest is improved.

21) The electromagnetic control valves Y1, Y2 and Y3 are configured to realize centralized control over the air paths, and corresponding ironing strategies are selected according the specific conditions of to-be-ironed fabric, so that the ironing effect, the ironing efficiency and the economic benefit are ensured.

22) The two sections of the roller can still be respectively connected with the fan and the speed reducer between which there is an apparent weight difference, so that equipment transformation is small, and implementation is more convenient.

DETAILED DESCRIPTION OF THE INVENTION

The invention is further described below with reference to specific embodiments.

Embodiment 1

Referring to FIGS. 1-5, a chest ironer of the invention has the biggest difference from common chest ironers in that solid chests and flexible chests are used in cooperation in terms of respective characteristics and the installation dimensions of frames of the solid chests and the flexible chests are kept consistent. The chest ironer is further described below with reference to the accompanying drawings.

Figure 1:
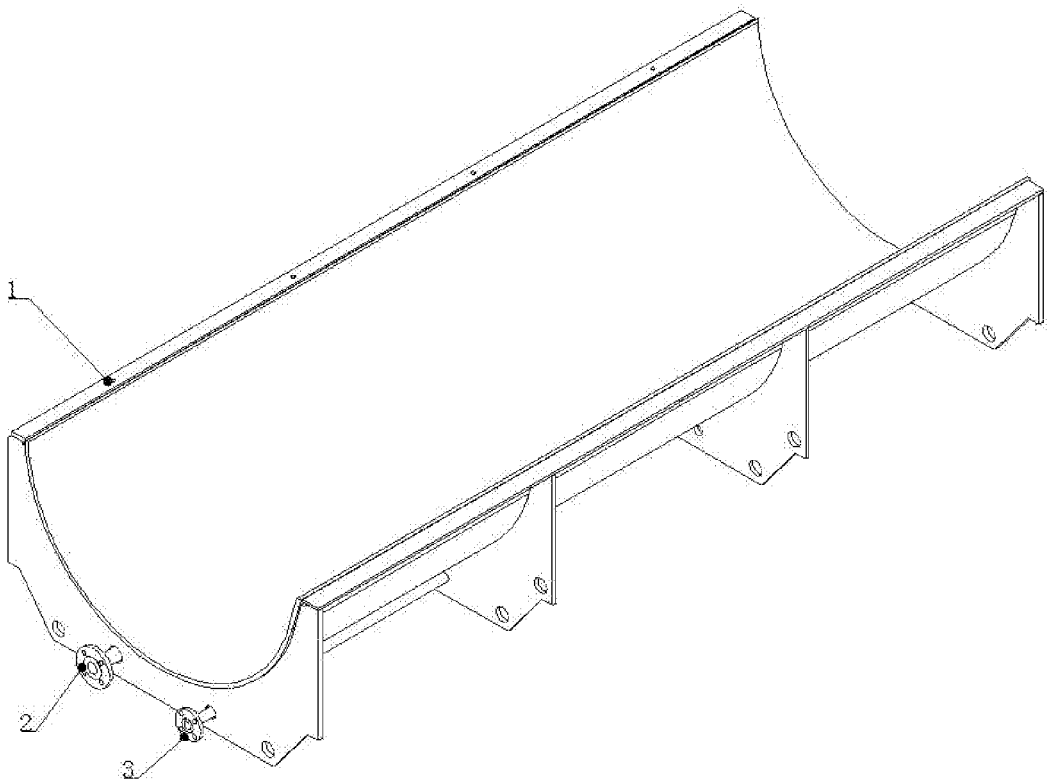
FIG. 1 is a structural view of a solid chest in embodiment 1.

A steam inlet 2 and a condensate outlet 3 of the solid chest are shown in FIG. 1. Steam flows through a steam chamber of the solid chest to transmit heat to a chest body. In FIG. 1, linen enters the solid chest from the right end and is discharged out of the solid chest from the left end. Four bridge chest installation holes 1 are formed in the surface of the left end of the solid chest and can be connected with corresponding bridge chest installation holes 12 in FIG. 3 through bolts 21.

Figure 2:
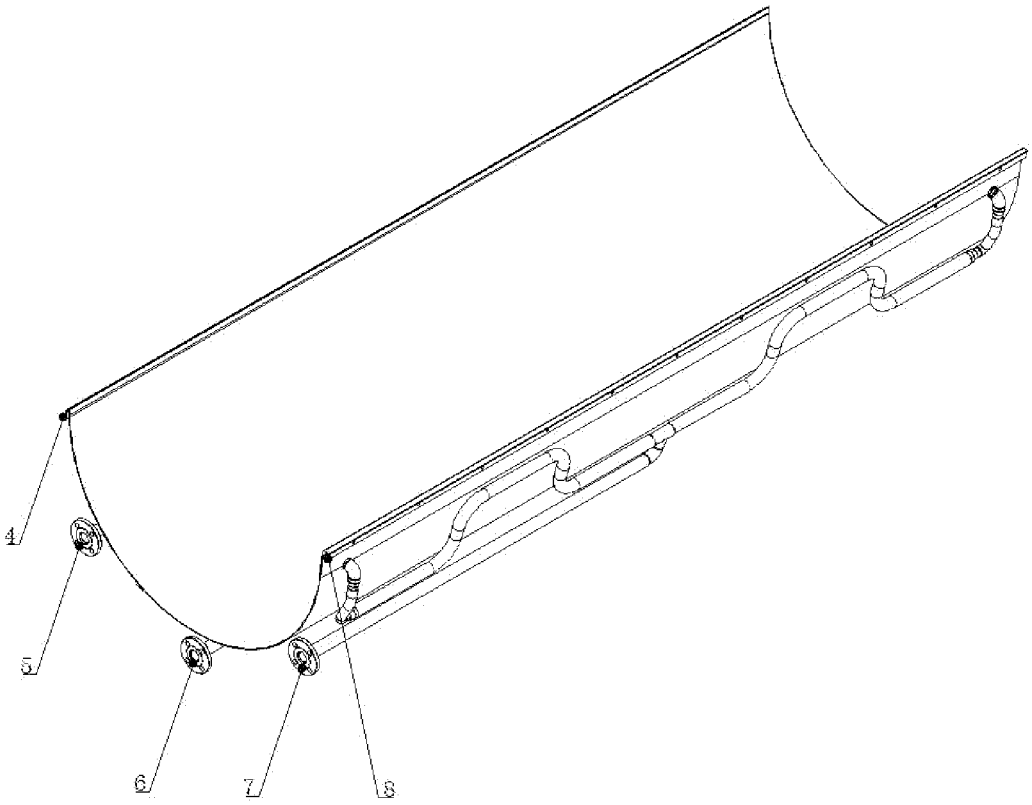
FIG. 2 is a structural view of a flexible chest in embodiment 1.

Steam inlets 5 and 7 and a condensate outlet 6 of the flexible chest are shown in FIG. 2. In FIG. 2, the left side is a discharging side and is provided with a rear supporting plate installation site 4 in the length direction, and the right side is a feeding side and is provided with a front supporting plate installation site 8.

Figure 3:
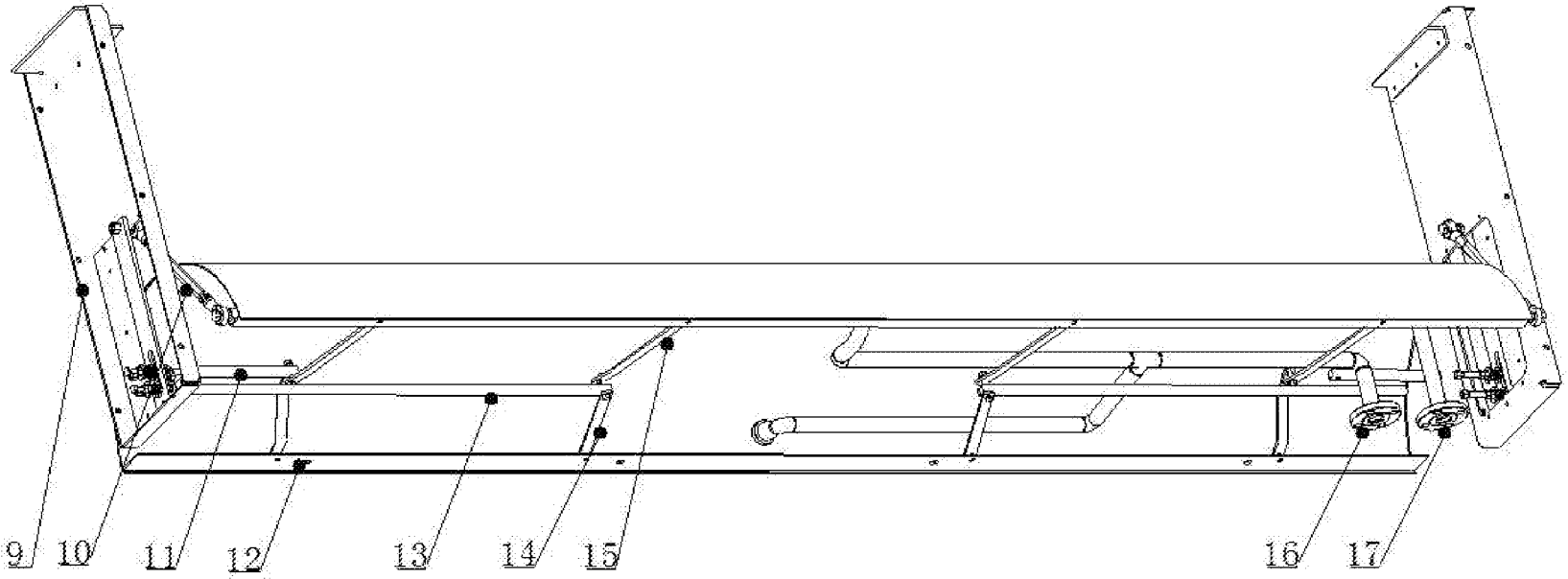
FIG. 3 is a structural view of a bridge chest in embodiment 1.

FIG. 3 shows a bridge chest and an assembled structure of the bridge chest. The bridge chest can be regarded as an inverted flexible chest. In contrast with the flexible chest, an outer semicircular surface of the bridge chest is made from a thick steel plate, an inner arc surface of the bridge chest is made from a thin steel plate which expands to form a steam chamber after being filled with water, and the bridge chest made in such manner can be adjusted within a wide range. Reference sign 17 refers to a steam inlet, reference sign 16 refers to a condensate outlet, and reference sign 9 refers to an installation frame, having two sides respectively connected with a front chest and a rear chest, of the bridge chest. After the installation holes 12 at the inlet end of the bridge chest and the threaded holes 1 of the solid chest are connected through the bolts 21, an adjustment screw rod 10 is installed on each of the installation frames on the two sides of the bridge chest, and the other end of each adjustment screw rod 10 is connected with the lower edge of the discharging end of the bridge chest. In addition, eight connecting rods 14 and 15 are arranged in the bridge chest, wherein each connecting rod 14 has an end fixed to the end of the bridge chest and an end forming a cross structure together with the corresponding connecting rod 15 through a bolt and a tie rod 13. The connecting rods 14 and 15 can be driven to adjust the opening degree of the bridge chest by tightening or loosening the screw rods at the outer ends of the tie rods 11 and 13. The connecting rods 14 and 15 are uniformly distributed at two ends of the bridge chest in the length direction. The lower edge of the discharging end of the bridge chest and the upper edge of the feeding end of the flexible chest can be aligned with a certain gap reserved therebetween through the connecting rods 14 and 15 and the adjustment screw rods 10, and thus, it is ensured that linen smoothly enters the next chest from the current chest.

Figure 4:
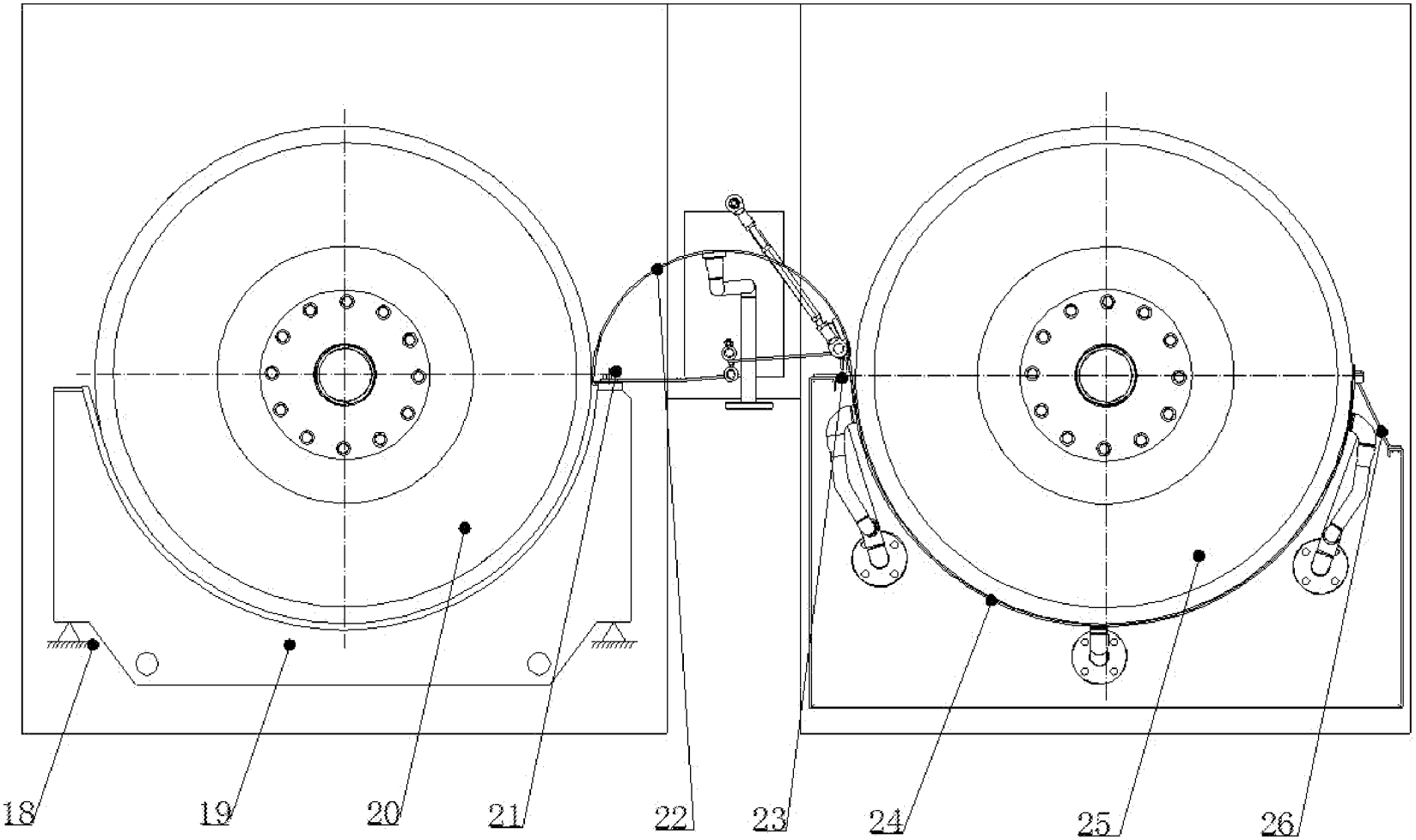
FIG. 4 is a schematic view of one ironing chest set of a chest ironer in embodiment 1.
Figure 5:
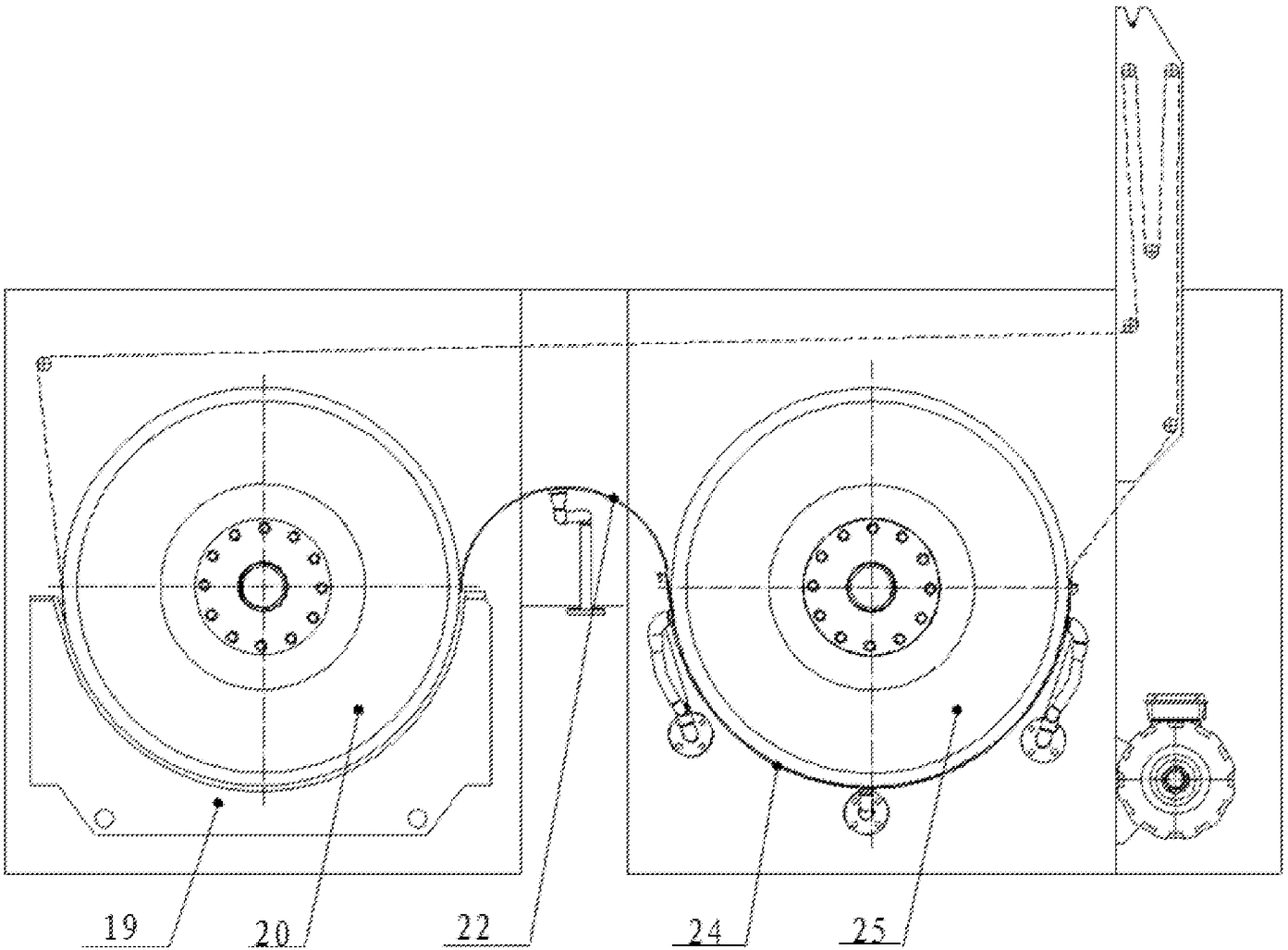
FIG. 5 is a schematic view of a chest ironer with a front rigid ironing chest and a rear flexible ironing chest (two ironing chests) in embodiment 1.

FIG. 4 is a schematic view of one ironing chest set of the chest ironer in this embodiment. As can be seen from FIG. 1, a plate sealing part at each of the two ends of the solid chest has four planes through which the solid chest 19 is fixed to installation sites 18 on the frame bearing the weights of the solid chest 19 and the roller 20 as well as the pressure from the roller 20. The bridge chest 22 is fixed to the frames of the solid chest and the flexible chest through the installation frames 9. The discharging end of the bridge chest is connected with the feeding end of the flexible chest. The flexible chest 24 is installed in a way different from the solid chest 19. Particularly, one end of the front supporting plate 23 is fixed to the frame, and the other end of the front supporting plate 23 is connected to the front supporting plate installation site 8 in FIG. 2. The rear supporting plate 26 is installed in a similar way, but as the rear supporting plate is wide, the rear supporting plate is able to move towards the center of the roller 25 under the pressure of the roller 25 after a lower end of the rear supporting plate is fixed to the frame and an upper end of the rear supporting plate is inserted into the rear supporting plate installation site 4. This flexible design enables the pressures borne by the linen at the bottom and the two ends of the chest basically identical, thus, realizing a better ironing effect.

The ironing machine in this embodiment combines the good heat storage performance of the solid chest and the good ironing effect of the flexible chest. Linen containing a large quantity of moisture firstly enters the solid chest in which most moisture in the linen is taken away, and halts caused by a sudden temperature drop, resulting from insufficient steam supply, of the chest body are avoided; afterwards, the damp-dry linen enters the flexible chest, thanks to the rapid heat-exchange capacity, smooth contact surface and good wrapping performance of the flexible chest of the thin plate structure, a good ironing quality is realized, and potential problems caused by full-solid chests or full-flexible chests are avoided for domestic laundries.

Embodiment 2

A common solid chest is typically provided with a steam port flange and a condensate port flange, wherein the steam port flange is connected with an external steam pipeline, and the condensate port flange is connected with a steam trap and a condensate recovery pipeline. An inner chest plate in contact with linen is a semicircular steel plate which is open upwards, arc-shaped steam chamber plates are stacked on the back of the inner chest plate layer by layer, and a steam channel is formed by the inner arc surfaces of the steam chamber plates and the outer arc surface of the inner chest plate. Each arc-shaped steam chamber plate is provided with a notch in an area overlapping with the next arc-shaped steam chamber plate, so that the circulation of steam in all layers of the steam chamber is ensured. Steam enters the steam chamber from a steam chamber inlet. Condensate is discharged from the bottom of the arc-shaped ironing chest. The ends of the steam chamber plates at the two top sides are each provided with an exhaust port through which air in the steam chamber can be exhausted before steam enters the steam chamber.

Figure 8:
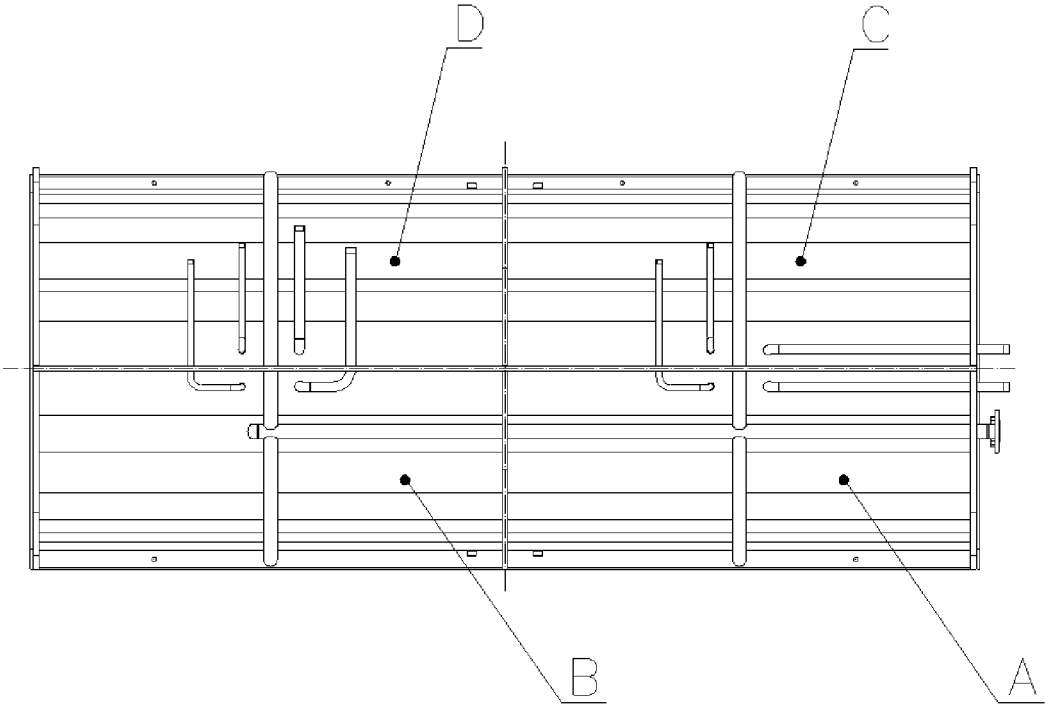
FIG. 8 is schematic view of part A, part B, part C and part D of the multi-cavity solid chest in embodiment 2.

The invention provides a multi-cavity rigid ironing chest. As shown in FIG. 8, a steam chamber in the multi-cavity rigid ironing chest is partitioned into a cavity A, a cavity B, a cavity C and a cavity D, wherein the four cavities are independent of one another and are each provided with an independent steam inlet port, an independent exhaust port and an independent drain port. Thus, the heating efficiency is improved.

Figure 6:
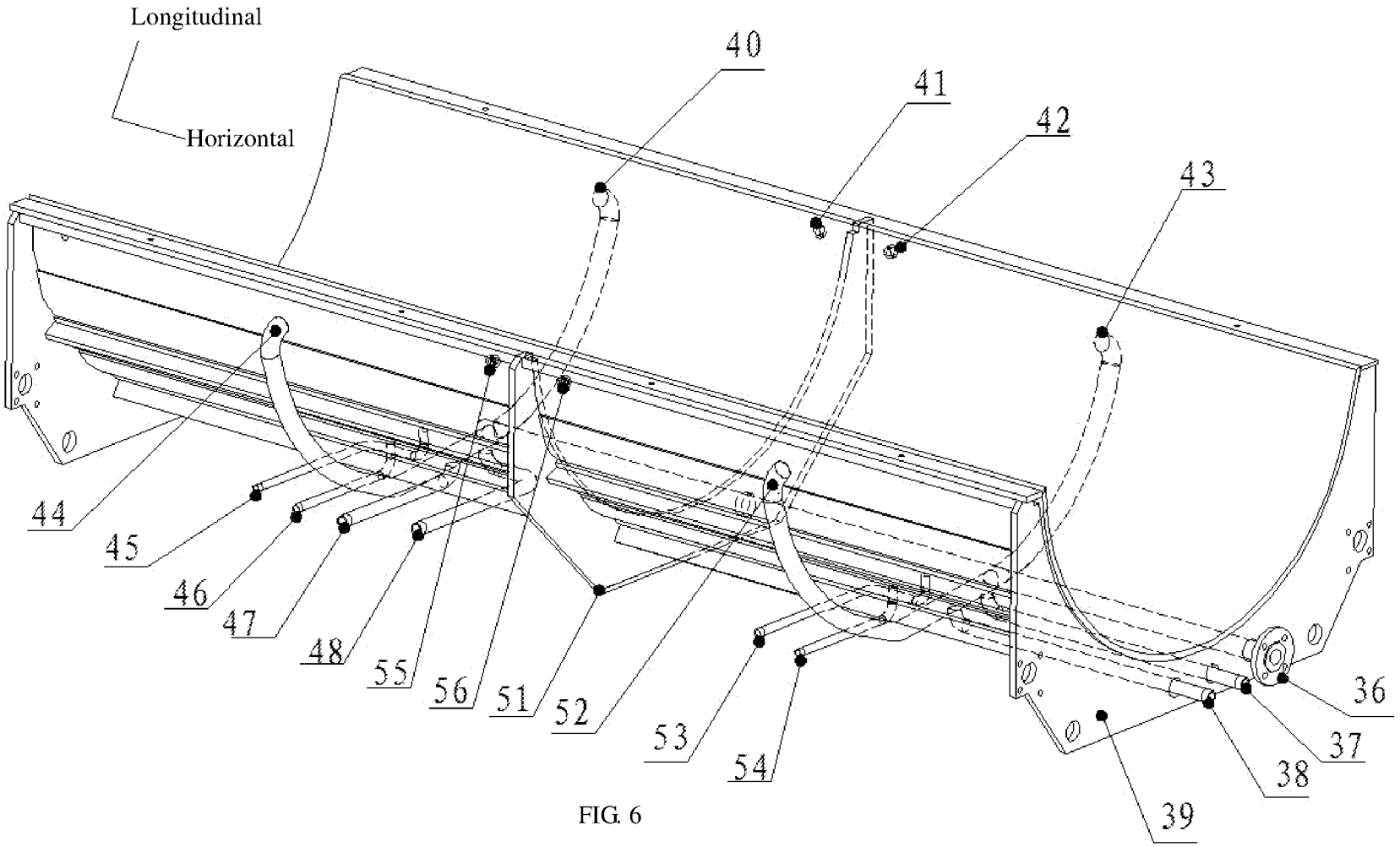
FIG. 6 is a perspective view of a multi-cavity solid chest in embodiment 2.
Figure 7:
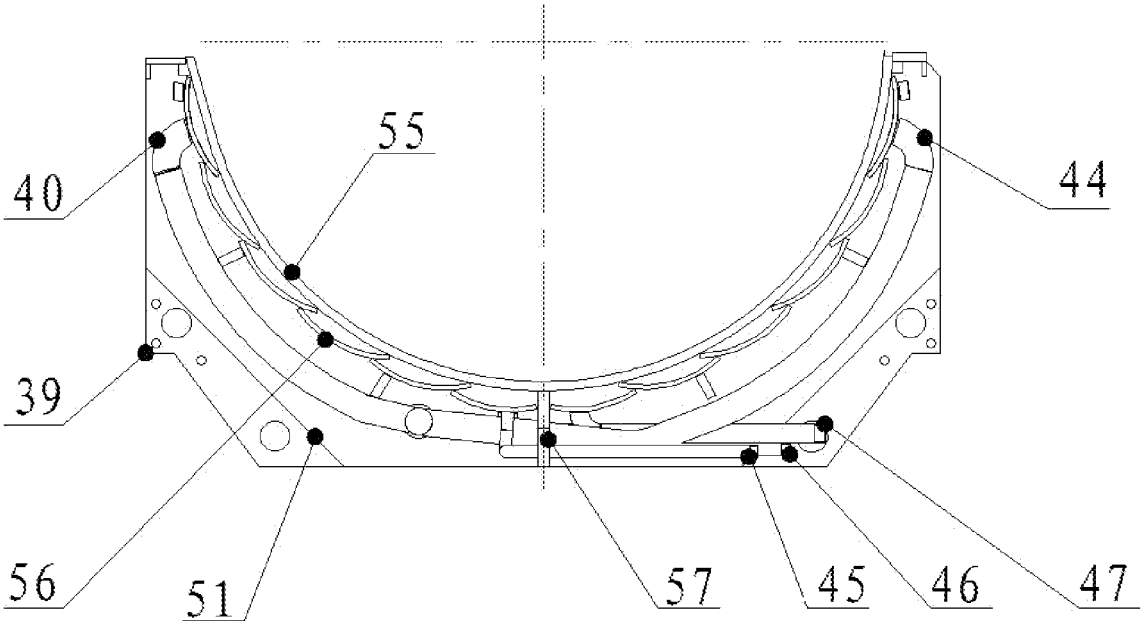
FIG. 7 is a left view of the multi-cavity solid chest in embodiment 2.

As shown in FIGS. 6-7, a horizontal steam chamber partition plate 57 and longitudinal steam chamber partition plates 51 are additionally arranged on the outer arc surface of the inner chest plate of the multi-cavity rigid ironing chest, so that the arc-shaped steam chamber plate is no longer an integral section from one end to the other end. Meanwhile, the bottom end of the steam chamber plate is partitioned by the horizontal steam chamber partition plate 57 into two parts. The steam chamber of the ironing chest is partitioned into four independent steam chambers, wherein the steam chambers on two sides of the horizontal steam chamber partition plate 57 are symmetrically distributed, and the adjacent steam chambers on the same side of the horizontal steam chamber partition plate 57 are completely identical. In this way, the independent steam chambers are of the same structure and theoretically have the same heating effect, so that the ironing chest formed by the independent steam chambers can be evenly heated.

Referring to FIGS. 6-7, steam is supplied to steam inlets 40, 43, 44 and 52 of the independent steam chambers of the solid chest in a centralized manner through one steam port flange. At the bottom of the ironing chest, each steam chamber is provided with two drain pipes, wherein condensate drain pipes 37, 38, 47 and 48 provided with steam traps have different sizes and functions from bypass drain pipes 45, 46, 53 and 54. The condensate drain pipes 37, 38, 47 and 48 are mainly used for discharging condensate, which is continuously generated in the ironing chest through heat exchange when the ironing machine works, out of the ironing machine via the external steam traps and generally have a size of DN25. The bypass drain pipes 45, 46, 53 and 54 are used for rapidly discharging initial condensate left in the ironing chest and are closed after the chest body is heated, and condensate is then discharged via the stream traps of the condensate drain pipes 37, 38, 47 and 48.

Referring to FIGS. 6-7, exhaust ports 41, 42, 55 and 56 at the top ends of the steam chamber plates in the independent areas are connected with automatic steam exhaust valves so that air left in the ironing chest can be exhausted and the steam chambers of the ironing chest can be rapidly filled with steam. Thus, the heating efficiency is improved.

Referring to FIG. 2, the condensate drain pipes 37, 38, 47 and 48 are connected to a main condensate recovery pipeline via corresponding steam traps, and the bypass drain pipes 35, 36, 43 and 44 are combined through a drain valve to be connected to the main condensate recovery pipeline.

Referring to FIGS. 2-4, particularly, a longitudinal steam chamber partition plate 51 is arranged on an outer arc-shaped face plate of the inner chest plate in the longitudinal direction, so that the ironing chest is partitioned into four steam chambers.

The bypass drain pipes are provided with pressure sensors and electric control valves. The pressure sensors are electrically connected with the electric control valves. When the steam pressure is lower than a set value, the electric control valves are opened. When the steam pressure is higher than the set value, the electric control valves are closed.

The volume of each steam chamber is smaller than 30 L.

Referring to FIG. 6, the steam chamber partition plate additionally arranged at the middle position of the solid chest downwards protrudes out of the outer arc-shaped face plate to serve as a reinforcing rib of the inner chest plate and the outer arc-shaped face plate.

Embodiment 3

Figure 9:
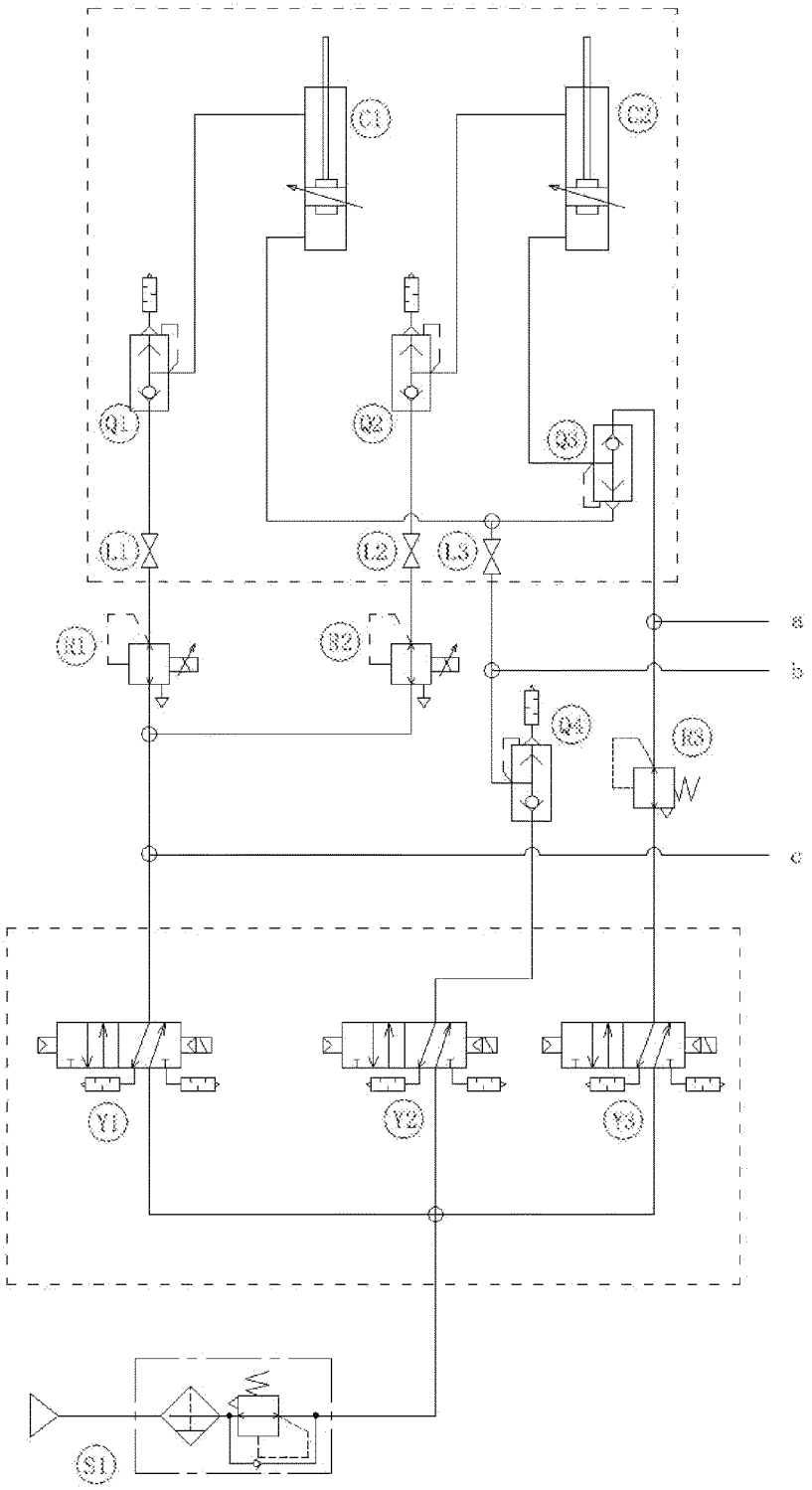
FIG. 9 is a structural view of an adjustable pressurization system of the chest ironer in embodiment 3.

Referring to FIG. 9, an adjustable pressurization system of a chest ironer comprises roller lifting cylinders C1 and C2, electro-pneumatic regulators R1 and R2, a pressure regulating valve R3, electromagnetic valves Y1, Y2 and Y3, and a quick exhaust valve Q3. Compressed air is converted by a filter pressure reducing valve S1 into an air supply at a pressure of 0.6 MPa, the air supply is connected to an electromagnetic valve set including the three electromagnetic valves Y1, Y2 and Y3, wherein the electromagnetic valve Y1 is able to lower the roller by controlling air paths of rod cavities of the cylinders to lower the roller, the electromagnetic valve Y2 is able to lift the roller by controlling air paths of rodless cavities of the cylinders, and the electromagnetic valve Y3 is able to control the air path of the rodless cavity of the cylinder C2 on the transmission side of the roller to allow air to enter the cylinder C2 and to prevent air from entering the cylinder C1.

The cylinders C1 and C2 are connected with the flanges on the two sides of the roller through two bearing seats respectively. Piston rods of the cylinders stretch or retreat to lift or lower the roller without affecting the rotation of the roller. The cylinder C1 corresponding to the exhaust port flange. The cylinder C2 corresponds to the transmission shaft flange. The electro-pneumatic regulators R1 and R2 respectively control the pressures of the two air paths. After the electromagnetic valve Y1 is powered on, air is supplied to outlets of the electro-pneumatic regulators R1 and R2 to lower the roller. When the roller is lowered to the bottom position, air is supplied again, and then a downward pressure from the cylinders is applied to the roller.

After the electromagnetic valve Y2 is powered on, air enters the rodless cavities of the cylinders C1 and C2, air in the rodless cavities of the cylinders C1 and C2 is exhausted via quick exhaust valves Q1 and Q2 connected to an air pipe, and the piston rods of the cylinders stretch to push the bearing seats to rapidly lift the roller. On the contrary, when the roller needs to be lowered, air in the rodless cavities of the cylinders is rapidly exhausted via a quick exhaust valve Q4, and then the roller is rapidly lowered.

The electromagnetic valve Y3 controls air intake of the rodless cavity of the cylinder C2 (corresponding to the transmission shaft flange), so that when the ironing machine works, the addition path of air applies an upward force to the piston rod of the cylinder C2 to regulate the pressure of the pressure reducing valve R3 and to counteract the weight difference between the speed reducer connected with the transmission shaft and the other side of the roller. The path of balance air controlled by the electromagnetic valve Y3 has an important distribution element, namely the quick exhaust valve Q3 provided with an air inlet connected with compressed air from the pressure reducing valve R3, an air outlet connected to the rodless cavity of the cylinder C2 and an exhaust port connected to the rodless cavity of the cylinder C1; and in terms of the characteristics of the quick exhaust valve, air flow entering the quick exhaust valve via the air inlet can be exhausted only via the air outlet, and air flow entering the quick exhaust valve via the air outlet or the exhaust port can be exhausted via the exhaust port or the air outlet and cannot flow towards the air inlet. After entering the quick exhaust valve Q3 via the air inlet, the balance air can be exhausted only via the air outlet, so that the cylinder C2 is lifted while the cylinder C1 will not move. When the cylinders C1 and C2 need to be lifted or lowered at the same time, the rodless cavities of the two cylinders are communicated, so that air enters or comes out of the two cylinders at the same time.

Manual stop valves L1 and L2 respectively control the air paths of the rod cavities of the two cylinders C1 and C2, and a manual stop valve L3 controls the air paths of the rodless cavities of the two cylinders C1 and C2. When the manual stop valves are closed, air is prevented from entering or coming out of the cylinders, and thus, the cylinders are locked.

Air path ports a, b and c are used to be connected with a multi-roller unit. In a chest ironer system including two or three chests, rising, falling and pressurizing of all roller cylinders are controlled in a unified manner by the three electromagnetic valves Y1, Y2 and Y3.

Motions of the rollers of a multi-chest ironer are independently controlled by respective manual stop valves.

After the electromagnetic valve Y1 is powered on, compressed air flows through the electro-pneumatic regulators R1 and R2 via a tee joint, and a current control mode or a voltage control mode is adopted in this process, particularly, a 4-20 mA current signal or a 0-5V voltage signal is output by a PLC to control the pressure at the outlet. When the roller needs to be lowered, a high air pressure is output to rapidly lower the roller. The cylinders are provided with magnetic switches capable of detecting the rising/falling extreme position of the roller. When the roller is lowered in position, the ironing machine starts to work. Different pressurization values are selected according to different types of linen. When thin bed sheets are processed, the cylinders are not pressurized, the pressures at two sides are regulated to be equal only by means of the balance air, and then a good ironing effect and a high ironing speed are realized. When quilt covers are processed, the electro-pneumatic regulators output small air pressures, the cylinders apply small pressures to the roller, under the effect of the weight difference between the two sides of the roller, the air pressure applied to the cylinder C1 by the electro-pneumatic regulator R1 is smaller than the air pressure applied to the cylinder C2 by the electro-pneumatic regulator R2, and the roller slightly presses against the linen. When quilt covers with large thicknesses or higher moisture contents are processed, the electro-pneumatic regulators output great air pressures, and the roller heavily pressed against the linen.

The pressure applied to the linen by the roller is measured by a tension meter. One end of a 1.5 m guide belt of the ironing machine is tied on a hook of the tension meter, the other end of the guide belt is drawn into the roller, a reading will be displayed by the tension meter by slowly pulling the guide belt, and the tension indicated by the reading corresponds to the pressure of the roller. The tensions of the two sides and the middle of the roller are measured under the conditions where the roller is pressed in position, pressed slightly or pressed heavily, air pressures output by the electro-pneumatic regulators R1, R2 and pressure reducing valve R3 are regulated according to the tension values to keep the tensions of the three points consistent, and in this way, the linen ironed in all pressurization states can be prevented against deformation. In actual field application by users, the pressure of the pressure reducing valve R3 is regulated to make the weights of the two sides of the roller balanced, then the pressures of the electro-pneumatic regulators R1 and R2 are regulated according to different types of linen, the state values are collated to form a database to be stored in a PLC, and programs used for outputting corresponding pressures without halts are compiled so that users can process various types of linen according to corresponding program numbers, and the optimal ironing effect and operating speed are obtained.

Two online humidometers are separately installed between a feeder and an inlet of the ironing machine as well as between the ironing machine and an outlet of a folding machine and are used to measure the humidity values of the linen before and after ironing in real time, the humidity values are fed back to the PLC for establishing the database, and then the ironing machine can automatically adjust the pressurization value and the operating speed and is more intelligent.

The three embodiments mentioned above are only preferred ones of the invention. Based on these preferred embodiments, various transformations or improvements can be made by those ordinarily skilled in this field without deviating from the general conception of the invention, and all these transformations or improvements should also fall within the protection scope of the invention.

What is claimed is:

1. A chest ironer, wherein:

the chest ironer comprises an ironing chest set including arc-shaped ironing chests with upward arc-shaped openings, the ironing chest set includes at least one solid chest and at least one flexible chest, and bridge chests with downward arc-shaped openings are arranged between the ironing chests;

the first ironing chest of the ironing chest set is a solid chest, the second ironing chest of the ironing chest set is a flexible chest, and the bridge chest between the first ironing chest and the second ironing chest is a first bridge chest;

bridge chest installation holes (1) to be connected with horizontal edges of the bridge chest are formed in horizontal edges of two ends of the solid chest, and the bridge chest (22) is fixed to a frames of the solid chest and the flexible chest through installation frames (9) on two sides of the bridge chest (22).

2. The chest ironer according to claim 1, wherein the installation frames on the two sides of the bridge chest are connected with one ends of adjustment screw rods (10), and another end of each said adjustment screw rod (10) is connected with a lower edge of a discharging end of the bridge chest; a plurality of sets of first and second connecting rods (14 and 15) are arranged in the bridge chest, each said first connecting rod (14) has an end fixed to an end of the bridge chest and an end forming a cross structure together with the corresponding second connecting rod (15) through a bolt and a tie rod (13), and the first and second connecting rods (14 and 15) are driven to adjust an opening degree of the bridge chest by tightening or loosening the screw rods at outer ends of the tie rods (13).

3. The chest ironer according to claim 2, wherein the first and second connecting rods (14 and 15) are uniformly distributed at two ends of the bridge chest in a length direction, and the lower edge of the discharging end of the bridge chest and an upper edge of a feeding end of the flexible chest are aligned with a certain gap reserved therebetween through the first and second connecting rods (14 and 15) and the adjustment screw rods (10) to make sure that linen smoothly enters the next chest from the current chest.

4. The chest ironer according to claim 3, wherein each of plate sealing parts on two sides of the solid chest has four planes through which the solid chest (19) is fixed to installation sites (18) on the frame bearing weights of the solid chest (19) and a roller (20) as well as a pressure from the roller (20), a front supporting plate (23) has an end fixed to the frame and an end connected to a front supporting plate installation site (8), and a rear supporting plate (26) is able to move towards a center of a roller (25) under a pressure of the roller (25) after a lower end of the rear supporting plate (26) is fixed to the frame and an upper end of the rear supporting plate (26) is inserted into a rear supporting plate installation site (4), so that pressures borne by the linen at a bottom and two ends of the solid chest are close, and a better ironing effect is achieved.

5. The chest ironer according to claim 1, wherein the ironing chest set includes three ironing chest, wherein the first ironing chest is a solid chest, the second chest is a bridge chest, and the third chest is a flexible chest.

6. The chest ironer according to claim 1, wherein the solid chest comprises an inner chest plate and outer arc-shaped face plate;

a horizontal steam chamber partition plate (57) is fixedly arranged at a longitudinal middle position of the outer arc-shaped face plate of the inner chest plate in a horizontal direction, and at least one longitudinal steam chamber partition plate (51) is arranged on the outer arc-shaped face plate of the inner chest plate in a longitudinal direction, so that the ironing chest is partitioned into at least four steam chambers; the steam chambers on two sides of the horizontal steam chamber partition plate (57) are symmetrically distributed, and the adjacent steam chambers on a same side of the horizontal steam chamber partition plate (57) are completely identical;

each said steam chamber is provided with a branched steam pipe communicated with a main steam pipe used for centralized supply of steam.

7. The chest ironer according to claim 6, wherein each said steam chamber is provided with a condensate drain pipe and a bypass drain pipe, the condensate drain pipes are connected with steam traps, the bypass drain pipes are used for rapidly discharging initial condensate left in the ironing chest only when steam is initially supplied into the chest and are closed after a chest body is heated, and condensate is then discharged via the steam traps of the condensate drain pipes.

8. The chest ironer according to claim 6, wherein exhaust ports at top ends of steam chamber plates of the steam chambers are connected with automatic steam exhaust valves, so that air left in the ironing chest is exhausted, and the steam chambers of the ironing chest are rapidly filled with steam.

9. The chest ironer according to claim 6, wherein the condensate drain pipes are connected with a main condensate recovery pipeline via the corresponding steam traps, and the bypass drain pipes are combined through a drain valve to connected with the main condensate recovery pipeline.

10. The chest ironer according to claim 6, wherein one said longitudinal steam chamber partition plate (51) is arranged on the outer arc-shaped face plate of the inner chest plate in the longitudinal direction, so that the ironing chest is partitioned into four steam chambers.

11. The chest ironer according to claim 6, wherein temperature sensors are installed on the inner chest plate, the bypass drain pipes are provided with steam valves, and when a temperature of the ironing chest falls abnormally in a start-up pre-heating stage or an operating stage, a control system sends out a signal to open the steam valves, so that condensate accumulated in the ironing rough is rapidly discharged.

12. The chest ironer according to claim 6, wherein the steam chamber partition plate additionally arranged at the middle position of the solid chest downwards stretches out of the outer arc-shaped face plate to serve as a reinforcing rib of the inner chest plate and the outer arc-shaped face plate.

13. The chest ironer according to claim 1, wherein a roller of the chest ironer has two ends which are respectively a light end and a heavy end;

the chest ironer is provided with an adjustable pressurization system which comprises a pressure air supply, an electromagnetic valve set and at least one pressure control unit;

the pressure air supply is connected with the electromagnetic valve set, the electromagnetic valve set is connected with the at least one pressure control unit and includes an electromagnetic valve Y1, an electromagnetic valve Y2 and an electromagnetic valve Y3, and the pressure air supply is communicated with the electromagnetic valve Y1, the electromagnetic valve Y2 and an electromagnetic valve Y3;

the pressure control unit comprises a cylinder C1 located at the light end of the roller and a cylinder C2 located at the heavy end of the roller, and the electromagnetic valve Y1 is communicated with an electro-pneumatic regulator R1 and an electro-pneumatic regulator R2; the electro-pneumatic regulator R1 is communicated with an piston rod side of the cylinder and the electro-pneumatic regulator R2 is communicated with an piston rod side of the cylinder C2; the electromagnetic valve Y2 is communicated with rodless cavities of the cylinders C1 and C2; the electromagnetic valve Y3 is communicated with a rodless cavity end of the cylinder C2 through an electro-pneumatic regulator R3.

14. The chest ironer according to claim 13, wherein the pressure control unit further comprises quick exhaust valves Q1, Q2, Q3 and Q4, the electro-pneumatic regulator R1 is communicated with the piston rod side of the cylinder through the quick exhaust valve Q1, the electro-pneumatic regulator R2 is communicated with an piston rod end of the cylinder C2 through the quick exhaust valve Q2, the electro-pneumatic regulator R3 is communicated with a rodless cavity side of the cylinder C2 through the quick exhaust valve Q3, an air outlet of the quick exhaust valve Q3 is connected to the rodless cavity of the cylinder C2, and an exhaust port of the quick exhaust valve Q3 is connected to the rodless cavity of the cylinder C1.

15. The chest ironer according to claim 13, wherein the electromagnetic valves in the electromagnetic valve set are connected with other pressure control units through bypass air paths a, b and c respectively located on air paths of the electromagnetic valves Y1, Y2 and Y3, and each said pressure control unit corresponds to one roller of the ironing machine.

16. The chest ironer according to claim 13, wherein the cylinders C1 and C2 are connected with flanges on two sides of the roller through two bearing seats respectively, piston rods of the cylinders stretch or retreat to lift or lower the roller without affecting rotation of the roller, the air cylinder C1 corresponds to the exhaust port flange, the cylinder C2 corresponds to the transmission shaft flange, and the electro-pneumatic regulators R1 and R2 respectively control pressures of two air paths; after the electromagnetic valve Y1 is powered on, the roller is lowered under a combined effect of a self gravity and an air pressure; and when the roller is lowered to a bottom position, air is supplied to the electromagnetic valve Y1 again, so that a downward pressure from the cylinders is applied to the roller.

17. A pressurization method of the adjustable pressurization system of the chest ironer according to claim 13, comprising the following steps:

S1, powering on the electromagnetic valve Y1, so that air enters rod cavities of the cylinders C1 and C2, air in the rodless cavities of the cylinders C1 and C2 is exhausted via the quick exhaust valve Q3 connected to an air pipe under a combined action of a roller gravity and an air pressure, and then piston rods of the cylinders retreat to lower the roller in position;

S2, as for a light and thin to-be-ironed article, directly ironing the to-be-ironed article by means of the roller gravity; or, powering on the electromagnetic valve Y3 to control air intake on the rodless cavity side of the cylinder C2, so that an addition path of air provides an upward force for the piston rod of the cylinder C2 to regulate a pressure of the pressure reducing valve R3 and to counteract a weight difference between the heavy end and the light end;

as for a thick and heavy to-be-ironed article, continuing to power on the electromagnetic valve Y1 to apply a downward pressure to the roller, and carrying out pressure distribution in real time through the electromagnetic proportional valves R1 and R2 to make a pressure of the cylinder C2 at the heavy end lower than a pressure of the cylinder C1 at the light end, wherein a pressure difference between the heavy end and the light end is set as a gravity difference between the two ends of the roller; and S3, after the article is ironed, powering on the electromagnetic valve Y2 to control air intake on the rodless cavity sides of the cylinders C1 and C2, so that the roller is upwards lifted in position.

18. The pressurization method of the adjustable pressurization system of the chest ironer according to claim 17, characterized in that in step 2, the quick exhaust valve Q3 of the path of balance air controlled by the electromagnetic valve Y3 is provided with an air inlet connected with compressed air from the pressure reducing valve R3, an air outlet connected to the rodless cavity of the cylinder C2 and an exhaust port connected to the rodless cavity of the cylinder C1; in terms of characteristics of the quick exhaust valve, air flow entering the quick exhaust valve via the air inlet can be exhausted only via the air outlet, and air flow entering the quick exhaust valve via the air outlet or the exhaust port can be exhausted only via the exhaust port or the air outlet and cannot flow towards the air inlet; after entering the quick exhaust valve Q3 via the air inlet, the balance air is exhausted only via the air outlet, so that the cylinder C2 is lifted while the cylinder C1 will not move; when the cylinders C1 and C2 need to be lifted or lowered at the same time, the rodless cavities of the two cylinders are communicated, so that air enters or comes out of the two cylinders at the same time.

19. The pressurization method of the adjustable pressurization system of the chest ironer according to claim 17, wherein in step 3, after the electromagnetic valve Y2 is powered on, air enters the rodless cavities of the cylinders C1 and C2, and air in the rodless cavities of the cylinders is exhausted via the quick exhaust valves Q1 and Q2 connected to the air pipe, so that the piston rods of the cylinders stretch to push the bearing seats to rapidly lift the roller.

20. The pressurization method of the adjustable pressurization system of the chest ironer according to claim 17, wherein manual stop valves L1 and L2 respectively control air paths of the rod cavities of the cylinders C1 and C2, a manual stop valve L3 controls air paths of the rodless cavities of the cylinders C1 and C2, and when the manual stop valves are closed, air is prevented from entering or coming out of the cylinders, so that the cylinders are locked.

21. The pressurization method of the adjustable pressurization system of the chest ironer according to claim 17, wherein air path ports a, b and c are used to be connected to a multi-roller unit, and in a chest ironer system with two or three chests, rising, falling and pressurizing of all roller cylinders are controlled in a unified manner by the three electromagnetic valves Y1, Y2 and Y3.

22. The pressurization method of the adjustable pressurization system of the chest ironer according to claim 17, wherein pressures of the electro-pneumatic regulators R1 and R2 are regulated according to different types of linen, state values are collated to form a database to be stored in a PLC, and programs used for outputting corresponding pressures without halts are compiled so that users can process various types of linen according to corresponding program numbers; two online humidometers are separately installed between a feeder and an inlet of the ironing machine as well as between the ironing machine and an outlet of a folding machine and are used to measure humidity values of the linen before and after ironing in real time, the humidity values are fed back to the PLC for establishing the database, and then the ironing machine is able to automatically adjust a pressurization value and an operating speed.

* * * * *